US008499485B2

(12) United States Patent
Deros

(10) Patent No.: US 8,499,485 B2
(45) Date of Patent: Aug. 6, 2013

(54) SLIDING MOUNT ADAPTER DEVICE

(76) Inventor: Mark A. Deros, Lubbock, TX (US)

( * ) Notice: Subject to any disclaimer, the term of this patent is extended or adjusted under 35 U.S.C. 154(b) by 222 days.

(21) Appl. No.: 12/969,037

(22) Filed: Dec. 15, 2010

(65) Prior Publication Data

US 2011/0138673 A1 Jun. 16, 2011

Related U.S. Application Data

(60) Provisional application No. 61/284,280, filed on Dec. 15, 2009.

(51) Int. Cl.
*F41G 1/38* (2006.01)

(52) U.S. Cl.
USPC ..... 42/125; 42/124; 42/127

(58) Field of Classification Search
USPC ..... 42/126, 124, 125, 127
See application file for complete search history.

(56) References Cited

U.S. PATENT DOCUMENTS

| | | | | | |
|---|---|---|---|---|---|
| 2,237,395 | A * | 4/1941 | Sweet | 42/126 |
| 2,583,260 | A * | 1/1952 | Felix | 42/126 |
| 2,710,453 | A * | 6/1955 | Beverly | 42/128 |
| 2,768,461 | A * | 10/1956 | Whittemore et al. | 42/25 |
| 2,782,507 | A * | 2/1957 | Fallon et al. | 42/128 |
| 3,153,856 | A * | 10/1964 | Felix | 42/127 |
| 3,178,823 | A * | 4/1965 | Lipski | 42/126 |
| 4,742,636 | A * | 5/1988 | Swan | 42/126 |
| 5,144,752 | A * | 9/1992 | Boeke et al. | 42/126 |
| 5,680,725 | A | 10/1997 | Bell | |
| 6,449,893 | B2 | 9/2002 | Spinner | |
| 6,606,813 | B1 | 8/2003 | Squire | |
| 6,629,381 | B1 | 10/2003 | Keng | |
| 6,722,075 | B1 | 4/2004 | Gabaldon | |
| 6,802,129 | B1 * | 10/2004 | Wirth | 33/265 |
| 7,204,052 | B2 | 4/2007 | Swan | |
| 7,272,904 | B2 | 9/2007 | Larue | |
| 7,367,152 | B2 | 5/2008 | Samson | |
| 7,481,016 | B2 | 1/2009 | Gonzalez | |
| 7,614,175 | B2 | 11/2009 | Davis | |
| 7,685,759 | B2 | 3/2010 | Teetzel | |
| 7,757,422 | B1 | 7/2010 | Swan | |
| 7,757,423 | B1 | 7/2010 | Swan | |
| 7,814,698 | B2 * | 10/2010 | Fluhr et al. | 42/127 |
| 7,908,782 | B1 * | 3/2011 | LaRue | 42/128 |
| 8,327,574 | B2 * | 12/2012 | Sandler et al. | 42/126 |
| 8,336,247 | B2 * | 12/2012 | Haering | 42/127 |
| 2006/0162227 | A1 * | 7/2006 | Samson | 42/148 |
| 2008/0289201 | A1 * | 11/2008 | Kroening, Jr. | 33/265 |
| 2009/0038201 | A1 | 2/2009 | Cheng | |
| 2010/0005697 | A1 * | 1/2010 | Fluhr et al. | 42/111 |
| 2010/0107467 | A1 | 5/2010 | Samson | |

* cited by examiner

*Primary Examiner* — Michelle Clement
(74) *Attorney, Agent, or Firm* — Sarah Hegi Simpson; McWhorter, Cobb & Johnson, LLP

(57) ABSTRACT

A mount adapter device is disclosed which utilizes a sliding mechanism for repositioning accessories attached to a firearm between operative and inoperative positions relative to the firearm. The sliding mount adapter device generally includes a base member, a guiding member, and a sliding member. The base member is configured to be attached to a firearm. The sliding member includes an upper portion configured to receive and retain an accessory. The sliding member is slidably engaged with the guiding member such that the sliding member may be repositioned between a first position relative to the base member and a second position relative to the base member by being slidably moved across the guiding member which is connected to the base member.

15 Claims, 6 Drawing Sheets

SLIDING MOUNT ADAPTER DEVICE

CROSS-REFERENCE TO RELATED APPLICATIONS

This application is related to and claims priority from earlier filed U.S. Provisional Patent Application No. 61/284,280, filed Dec. 15, 2009.

BACKGROUND OF THE INVENTION

1. Field of the Invention

The present invention relates generally to mounting devices for attaching various accessories to a support structure. More specifically, the present invention relates to mount adapter devices for slidably repositioning accessories attached to a firearm between operative and inoperative positions.

2. Description of the Prior Art

Universal weapon accessory rails such as the widely used "Picatinny rail" (i.e., MIL-STD-1913 rail) provide a standardized platform for attaching accessories to firearms. Today, such accessory rails are commonly mounted on firearms as they allow users to easily modify weapon configurations by attaching accessories to the mounting projections of the rails.

A broad range of accessories are available for attachment to firearms, including telescopic sights, holographic weapon sights, magnifiers, tactical lights, laser sights, infrared lights, and night vision devices. Firearm accessories, however, are not generally designed for direct attachment to weapon accessory rails. As a result, mount adapter devices are typically employed to releasably attach accessories to rails mounted on firearms.

Generally, prior art mount adapter devices serve to releasably lock an accessory in a fixed position above the firearm barrel in alignment with the longitudinal axis of the firearm. These devices generally utilize opposing clamping members in conjunction with a locking means (e.g., bolts, thumbscrews, levers, or push rods) to releasably lock the accessory in a fixed position on the rail. The locking means draws together the opposing clamping members which clamp to the mounting projections of the rail. This releasable locking mechanism allows a user to modify weapon configurations by selectively attaching, detaching, and reattaching accessories to the weapon as needed.

Oftentimes, however, a user does not have time to modify a weapon's configuration by detaching one accessory and attaching a different accessory. For example, military personnel utilize multiple sighting accessories that are each tailored to perform in different engagement situations. Military users, however, often need to transition instantaneously between close range engagement and medium or long range engagement, leaving them no time to modify weapon configurations by completely detaching one accessory and replacing it with another accessory. When military users are being targeted or fired at by multiple attackers from varying distances, each second that they spend interchanging accessories poses a great risk of being severely or mortally wounded. These users demand the versatility of being able to quickly transition between engaging a target at a close distance (e.g., approximately 50 meters or less) and engaging a target at a longer distance (e.g., more than 50 meters).

Not only is it more time-consuming to modify weapon configurations by completely detaching and reattaching accessories, it is also burdensome and inconvenient for users to carry or hold on to detached accessories. Accordingly, although accessories can significantly enhance firearm capabilities by providing for increased accuracy or broader functionality of the firearm, current mount adapter devices make field modification of weapon configurations burdensome, time-consuming, and oftentimes unfeasible.

Moreover, many accessories are designed to be used in combination with another accessory wherein the combination provides for an enhanced use. In this context, for example, a magnifier may be paired with a holographic weapon sight to add precise, longer ranging engagement ability to the firearm. As one can imagine, when using multiple accessories in combination, there are times when the user needs only one of the accessories (e.g., use of a holographic weapon sight for close range engagement) and there are other times when the user requires the combination of two accessories (e.g., use of a magnifier in combination with a holographic weapon sight for medium or long range engagement).

Accordingly, a device is needed that allows an attached accessory to be easily repositioned between an operative position, wherein the accessory is positioned for use with the firearm, and an inoperative position, wherein the accessory is positioned so that it does not interfere with the use of the firearm. One having skill in the art can further appreciate that with such an adjustable arrangement, while the accessory must be moveable, the accessory must also precisely realign in the exact same position relative to the firearm each time the accessory is placed back into the operative position. Such a feature allows an optical, sighting, or other aiming or targeting accessory to retain its zero position even after it has been repeatedly moved between the operative position and the inoperative position.

One type of prior art device is currently known that has attempted to address the aforementioned problems by employing a pivot mount to reposition accessories mounted on a firearm from an active position to an inactive position. In the active position, the accessory is positioned above the firearm barrel in alignment with the longitudinal axis of the firearm. In the inactive position, the accessory is either flipped or rotated approximately ninety (90) degrees so that the accessory is repositioned alongside the firearm. Design problems in these pivot mounts, however, present several disadvantages.

Generally, pivot mounts that employ a flipping mechanism to move the accessory to the inactive position are comprised of a top portion defining a mounting pad that receives and retains the accessory, and a lower portion defining a mounting base configured for attachment to a rail. When such pivot mounts flip the mounting pad, moving the accessory to the inactive position, the mounting pad forms an L-shape with the mounting base. This L-shaped configuration is fragile and prone to breakage. For example, upon dropping a firearm with an attached pivot mount in the inactive position, the mounting pad retaining the accessory is prone to break apart from the mounting base. Consequently, the fragile L-shaped configuration of these pivot mounts is not well-suited for many military or law enforcement settings wherein impacts with external objects (e.g., door frames and building walls) commonly occur. Moreover, upon breakage of the device in military or law enforcement engagement settings, these users would not have time to replace the broken device and would be forced to abandon the mission or to complete the mission without the aid of the required accessory.

Another problem with prior art pivot mounts is that they do not solve the ultimate goal of providing for efficient field modification of weapon configurations. These devices provide for an off-balanced and bulky weapon configuration as accessories in the inactive position protrude too far beyond the longitudinal axis of the firearm. This problem results from the pivoting mechanism employed by these devices that changes the orientation of the attached accessory by rotating the accessory approximately ninety (90) degrees from a position above the firearm (i.e., the active position) to a position alongside the firearm (i.e., the inactive position). When the accessory is pivoted to the inactive position, the accessory protrudes farther laterally than necessary for repositioning the accessory for non-use. As a result, pivot mounts and accessories in the inactive position become more susceptible to catching or snagging on external objects which can jerk the device and the accessory out of position, as well as break the device and the accessory.

An additional problem of devices employing pivot mounts occurs when excessive vibration, recoil, or accidental contact occurs with a locking means (e.g., a locking shaft or tab) which holds the accessory in the active position. Such accidental contact or jarring of the locking means causes the device to unlock and spring open to the inactive position even though such repositioning was not intended by the user. A further problem results because prior art pivoting mounts do not steadily hold accessories in a non-moving configuration while the accessory is in the inactive position. Instead, pivoting mounts allow attached accessories to move up and down in a hinging motion alongside the firearm barrel. Such movement is not only inconvenient and annoying to the user, it also creates a distraction that interferes with the use of the firearm.

In accordance with the foregoing, a mount adapter device is needed that allows a user to quickly and effortlessly modify weapon configurations by repositioning attached accessories between an operative position, wherein the accessory is positioned for use with the firearm, and an inoperative position, wherein the accessory is repositioned so that it does not interfere with the use of the firearm. At the same time, a device is needed that precisely realigns the accessory in the exact same zero position relative to the firearm each time that the accessory is placed back into the operative position. A device is needed that is compact, yet sturdy enough to withstand breakage of any parts that could render the device inoperable. Further, a device is needed that will not inadvertently unlock or release, causing the accessory to change positions when such a position change is not intended by the user. Opposed to prior art devices that allow accessories to swing up and down while attached to the firearm, a mount adapter device is needed that holds the accessory securely in place in both the operative position and in the inoperative position.

In view of the foregoing, it is apparent that there exists a need in the art for a mount adapter device which overcomes, mitigates, or solves the above problems in the art. It is a purpose of this invention to fulfill this and other needs in the art which will become more apparent to the skilled artisan once given the following disclosure.

OBJECTS AND SUMMARY OF THE INVENTION

It is an object of the present invention to overcome the above described drawbacks associated with prior art mount adapter devices. To achieve these and other advantages and in accordance with the purpose of the invention, as embodied and broadly described, the present invention provides for a mount adapter device that employs a sliding mechanism to reposition accessories between operative and inoperative positions on a firearm.

The sliding mount adapter device of the present invention generally comprises a base member having a lower portion configured to attach to a firearm, a guiding member connected to the base member, and a sliding member being slidably engaged with the guiding member and having an upper portion configured to receive and retain an accessory; wherein the sliding member is configured to be moved between a first position relative to the base member and a second position relative to the base member by being slidably moved across the guiding member which is connected to the base member. The device may further comprise a locking means configured to selectively retain or release the sliding member, wherein the locking means retains the sliding member in the first position when the locking means is selectively engaged with the sliding member, and wherein the locking means releases the sliding member to slide to the second position when the locking means is selectively disengaged from the sliding member. The device may further comprise a resilient member arranged and configured to urge the sliding member to slide to the second position upon selectively disengaging the locking means from the sliding member. In operation, a user may simply depress the locking means (e.g., a button, latch, tab, etc.) to disengage the locking means from the sliding member thereby allowing the resilient member, which may be compressed against the sliding member when the sliding member is engaged with the locking means, to decompress. In this manner, the resilient member may provide a force that urges the sliding member to slide across the guiding member from the first position relative to the base member to the second position relative to the base member. This sliding mechanism provides numerous advantages over prior art devices.

Foremost, the sliding mount adapter device of the present invention allows a user to quickly and effortlessly modify weapon configurations by sliding an attached accessory between operative and inoperative positions relative to the firearm. Likewise, more than one accessory may be attached to the firearm to allow the user to use the accessories in combination by positioning the accessories in the operative position on the firearm. The user could then quickly transition to using only one of the accessories by sliding the unneeded accessory to the inoperative position. Once the accessory in the inoperative position is again needed by the user, the user can simply slide the needed accessory back into the operative position. In this manner, the user can continue quickly and effortlessly modifying the weapon's configuration depending upon the needs of the user.

Moreover, the present device allows an accessory to be reliably and repeatedly repositioned between the operative and inoperative positions. The guiding member guides the sliding member back and forth between the operative position and the inoperative position and provides the accessory, which is attached to the sliding member, with the ability to retain its precise original orientation and alignment relative to the firearm each time the accessory is placed back into the operative position. Additionally, the sliding mechanism allows for the accessory to be repositioned by simply moving the sliding member in a lateral direction, which does not entail rotating the orientation of the accessory. Thus, the guiding system, in combination with the sliding mechanism, allows for optical, sighting, or other aiming or targeting accessories to be repeatedly repositioned between the operative and inoperative positions without the need for re-zeroing the device.

Another advantage provided by the sliding mechanism employed by the present invention is that it provides for a more compact weapon configuration compared to that of prior art devices, as it does not rotate or change the orientation of the accessory when repositioning the accessory into the inoperative position. The sliding mechanism allows the attached accessory to be moved a minimal amount of space in order to reposition the accessory for non-use with the firearm. Opposed to prior art pivot mounts which reposition inactive accessories in a different lateral position, as well as a different vertical position, relative to the firearm, the sliding mechanism of the present invention allows an accessory to be moved to the inoperative position by slightly changing only the lateral positioning of the accessory. This feature offers additional advantages such as allowing for quicker repositioning of the accessory and more accurate realignment.

An additional advantage of the present invention is that it may be configured to prevent the device from inadvertently unlocking and causing the accessory to change positions when such a position change is not intended by the user. The device may be configured and arranged to selectively impede movement of the locking means, thereby preventing the locking means from disengaging the sliding member. For example, in one of the embodiments contemplated by the current invention, the locking means 16 may be configured as a latch 16 which engages one or more grooves 19 formed on the surface 24 of the sliding member 14, thereby retaining the sliding member 14 in an engaged position. See FIG. 1. In this configuration, a front portion 22 of the latch 16 engages the grooves 19 on the sliding member 14. Normally, the user could disengage the latch 16 from the sliding member 14 by manually depressing 35 the rear portion 21 of the latch 16 so that the front portion 22 rotates upward 34 until the latch 16 disengages from the sliding member 14. See FIG. 7. However, the device 12 may be arranged to impede depression 35 and movement of the rear portion 21 of the latch 16, thereby preventing the latch 16 from disengaging the sliding member 14. For example, a push rod member 25 may optionally be used in conjunction with the lower portion 20 of the base member 13 as a means of attaching the device 12 to an accessory rail 28. The push rod member 25 generally includes a knob 30 that may be rotated in a first direction out to a position that impedes depression 35 and movement of the rear portion 21 of the latch 16. See FIG. 8. Then, once the user wishes to disengage the locking means 16 from the sliding member 24 for movement of the accessory 26 to the inoperative position, the push rod member 25 could be rotated or pushed inward in a second direction opposite the first direction into a position that allows for depression 35 of the rear portion 21 of the latch. See FIG. 7. This disclosure is provided to simply illustrate one means by which the locking means may be prevented from inadvertently unlocking. It can be appreciated by one skilled in the art that there are many other means that may be utilized for accomplishing this objective, all of which are considered to be within the spirit and scope of the present invention.

The present invention also includes features that allow it to hold the accessory attached to the sliding member securely in place in both the operative and the inoperative positions. Opposed to prior art pivot mounts wherein an accessory in an inactive position is unsecurely connected to the base of the mount by a rotating shaft or hinge, the sliding mechanism of the present device allows the accessory to remain securely attached to both the guiding member and base member at all times regardless of whether the accessory is in the operative or inoperative position.

These, together with other objects of the invention, along with various features of novelty that characterize the invention, are pointed out with particularity in the claims annexed hereto and forming a part of this disclosure. For a better understanding of the invention, its operating advantages, and the specific objects attained by its uses, reference should be had to the accompanying drawings and descriptive matter in which there is illustrated a preferred embodiment of the invention.

BRIEF DESCRIPTION OF THE DRAWINGS

The accompanying drawings, which are incorporated in and form a part of the specification, illustrate a preferred embodiment of the present invention, and together with the description, serve to explain the principles of the invention. It is to be expressly understood that the drawings are for the purpose of illustration and description only and are not intended as a definition of the limits of the invention. In the drawings.

DETAILED DESCRIPTION OF THE PREFERRED EMBODIMENTS

Referring now to FIGS. 1-12, an exemplary embodiment of a sliding mount adapter device 12 in accordance with the present disclosure is illustrated and principally includes a base member 13, a guiding member 15, and a sliding member 14.

Figure 12:
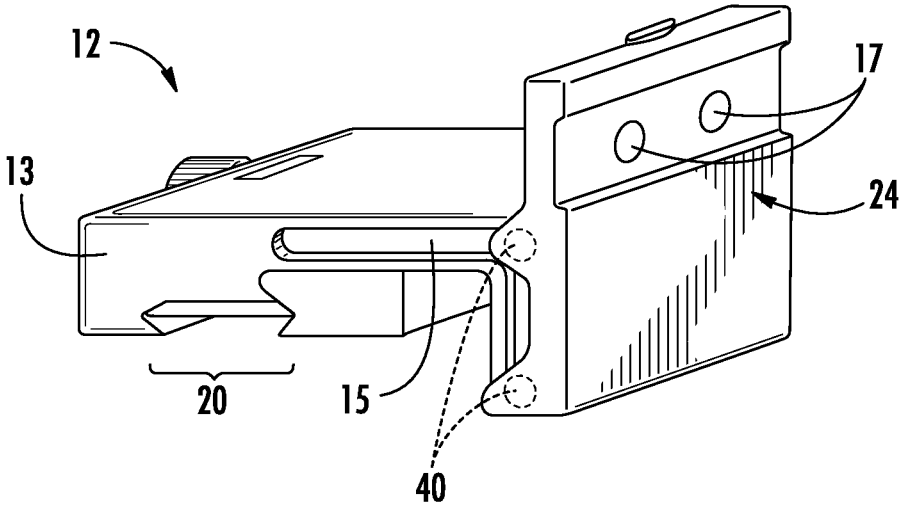
FIG. 12 is a side perspective view of an alternative embodiment of a sliding mount adapter device constructed in accordance with the teachings of the present disclosure.

The base member 13 is further configured to connect to at least one guiding member 15. The at least one guiding member 15 may define one or more elongated rods 15 as in the depicted embodiment wherein each of the two terminal ends of each rod 15 are affixed to oppositely facing, upwardly extending end structures 23 of the base member 13. The depicted embodiment, however, simply illustrates a means by which the guiding member 15 may be connected to the base member 13 such that the sliding member 14 may be guided across the guiding member 15 in a sliding movement from a first position relative to the base member 13 (see FIG. 1) to a second position relative to the base member 13 (see FIG. 2). There are many other configurations that may be utilized to provide for such guiding movement. For example, as illustrated in FIG. 12, the guiding member 15 may define one or more tracks or channels 15 formed in the base member 13 such that the sliding member 14 may slide along the channels 15 (e.g., by using one or more rotating wheels 40 attached to the sliding member 14 that rotate to slidably move the sliding member 14 along the channels 15). Likewise, although the accompanying Figures illustrate the device 12 as including two guiding members 15, other embodiments are contemplated wherein greater or lesser numbers of guiding members 15 are employed, only one guiding member 15 being necessary for guiding the sliding member 14 from a first position relative to the base member 13 to a second position relative to the base member 13. One skilled in the art can appreciate that there are numerous other possibilities that exist for guiding the sliding member 14 in a sliding movement from said first position to said second position, all of which are considered to be within the spirit and scope of the present invention.

The base member 13 is further configured to connect to at least one guiding member 15. The at least one guiding member 15 may define one or more elongated rods 15 as in the depicted embodiment wherein each of the two terminal ends of each rod 15 are affixed to oppositely facing, upwardly extending end structures 23 of the base member 13. The depicted embodiment, however, simply illustrates a means by which the guiding member 15 may be connected to the base member 13 such that the sliding member 14 may be guided across the guiding member 15 in a sliding movement from a first position relative to the base member 13 (see FIG. 1) to a second position relative to the base member 13 (see FIG. 2). There are many other configurations that may be utilized to provide for such guiding movement. For example, the guiding member 15 may define one or more tracks or channels 15 formed in the base member 13 such that the sliding member 14 may slide along the channels 15 (e.g., by using one or more rotating wheels 40 attached to the sliding member 14 that rotate to slidably move the sliding member 14 along the channels 15). Likewise, although the accompanying Figures illustrate the device 12 as including two guiding members 15, other embodiments are contemplated wherein greater or lesser numbers of guiding members 15 are employed, only one guiding member 15 being necessary for guiding the sliding member 14 from a first position relative to the base member 13 to a second position relative to the base member 13. One skilled in the art can appreciate that there are numerous other possibilities that exist for guiding the sliding member 14 in a sliding movement from said first position to said second position, all of which are considered to be within the spirit and scope of the present invention.

The sliding member 14 is configured and arranged to be slidably engaged with the at least one guiding member 15. In the depicted embodiment, the sliding member 14 includes a hole 33 therethrough for slidably receiving each guiding member 15. This configuration allows the sliding member 14 to slide from the first position relative to the base member 13 to the second position relative to the base member 13 while being guided across the at least one guiding member 15 (see FIGS. 5-7). Other configurations allowing the sliding member 14 to slide between the first and second positions while being guided across the at least one guiding member 15 can be appreciated by one skilled in the art and are intended to fall within the spirit and scope of the present invention.

Figure 8:
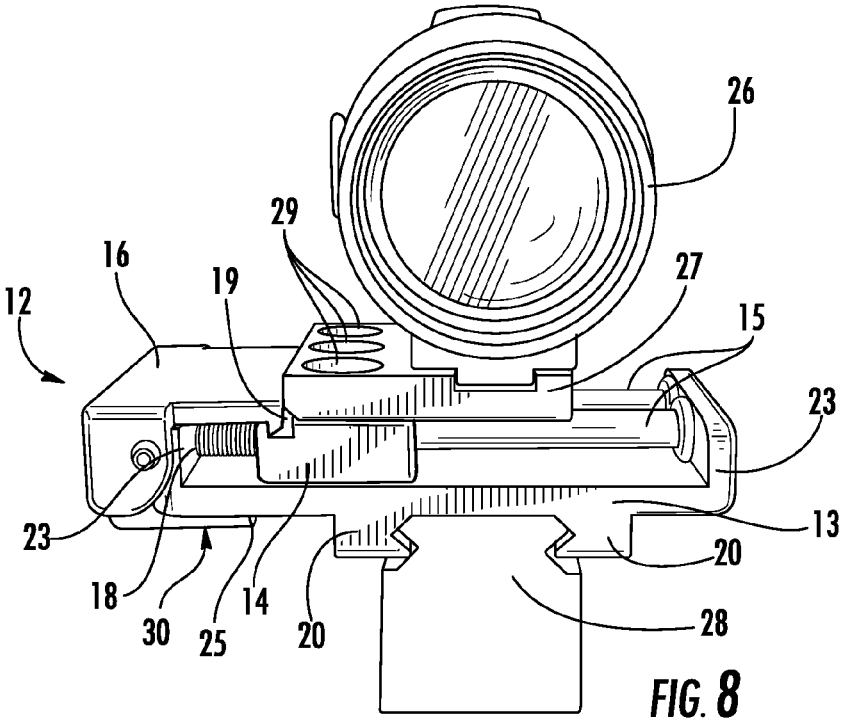
FIG. 8 is a side perspective view of the device shown in FIG. 1, illustrating the device attached to an accessory rail and depicting an accessory attached to the sliding member, with the sliding member in the engaged position.
Figure 9:
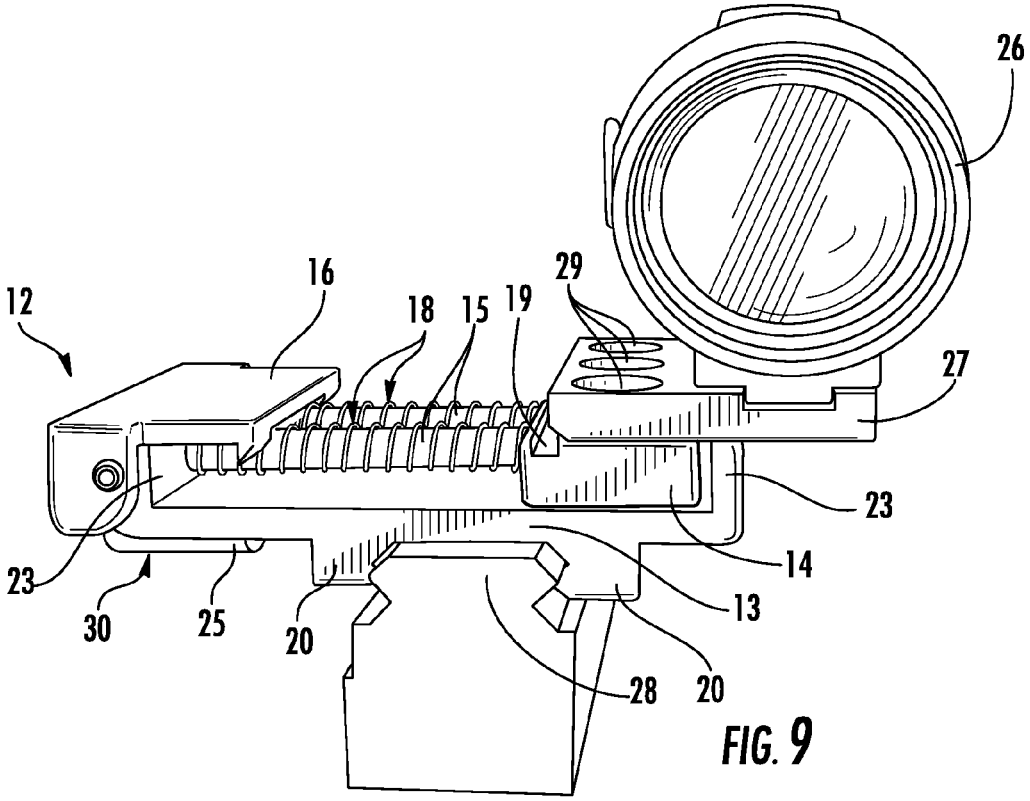
FIG. 9 is a side perspective view of the device shown in FIG. 1, illustrating the device attached to an accessory rail and depicting an accessory attached to the sliding member, with the sliding member in the disengaged position.

Additionally, the sliding member 14 includes an upper (in the orientation shown in FIGS. 1 and 2) surface 24 configured to receive and retain an accessory 26. In the depicted embodiment, the upper surface 24 includes multiple apertures 17 therein allowing passage of a fastener 29 through each aperture 17 for securing an accessory 26 to the upper surface (e.g., the accessory 26 may be affixed to a mounting base 29 which may be configured to attached to the sliding member 14 as illustrated in FIGS. 8 and 9). Other means for securing an accessory 26 to the device 12 that are known in the art may also be used and are considered to be within the spirit and scope of the present invention. Additionally, the upper surface 24 may be configured to receive and retain an additional rail structure 28 to allow for direct attachment of an accessory 26 to the additional rail structure 28.

Figure 1:
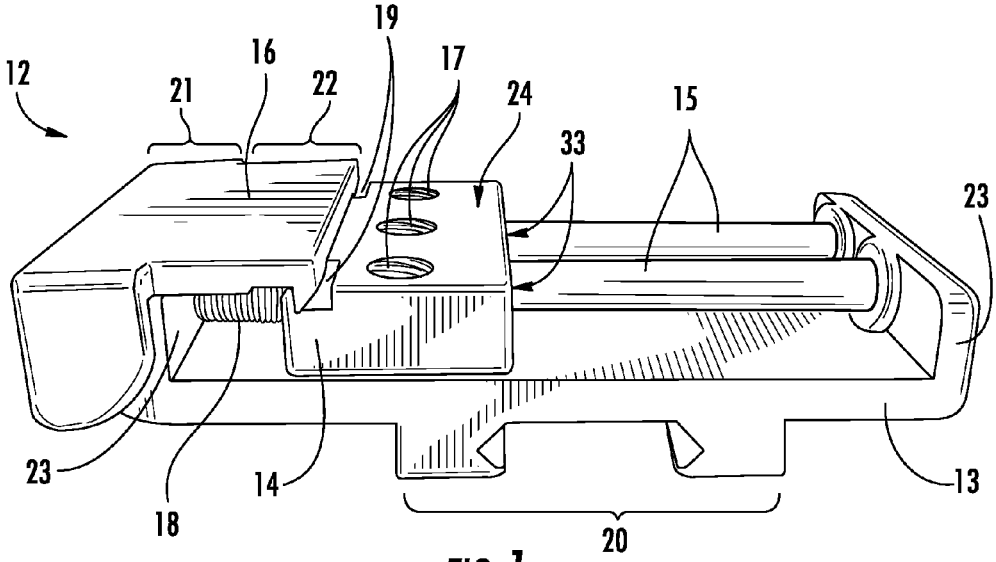
FIG. 1 is a side perspective view of a sliding mount adapter device constructed in accordance with the teachings of the present disclosure, with a sliding member in an engaged position.
Figure 2:
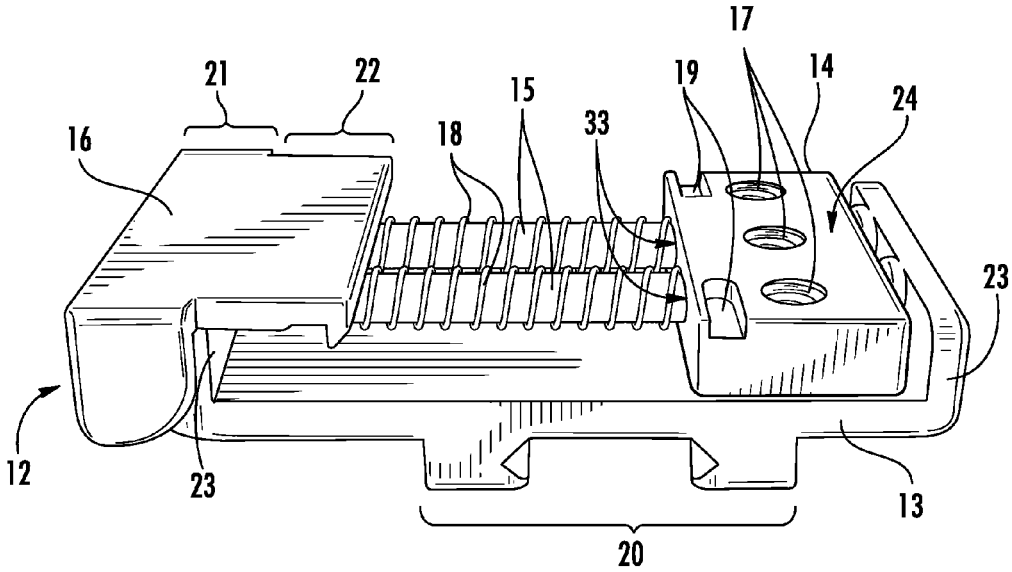
FIG. 2 is a side perspective view of the device shown in FIG. 1, with the sliding member in a disengaged position.
Figure 3:
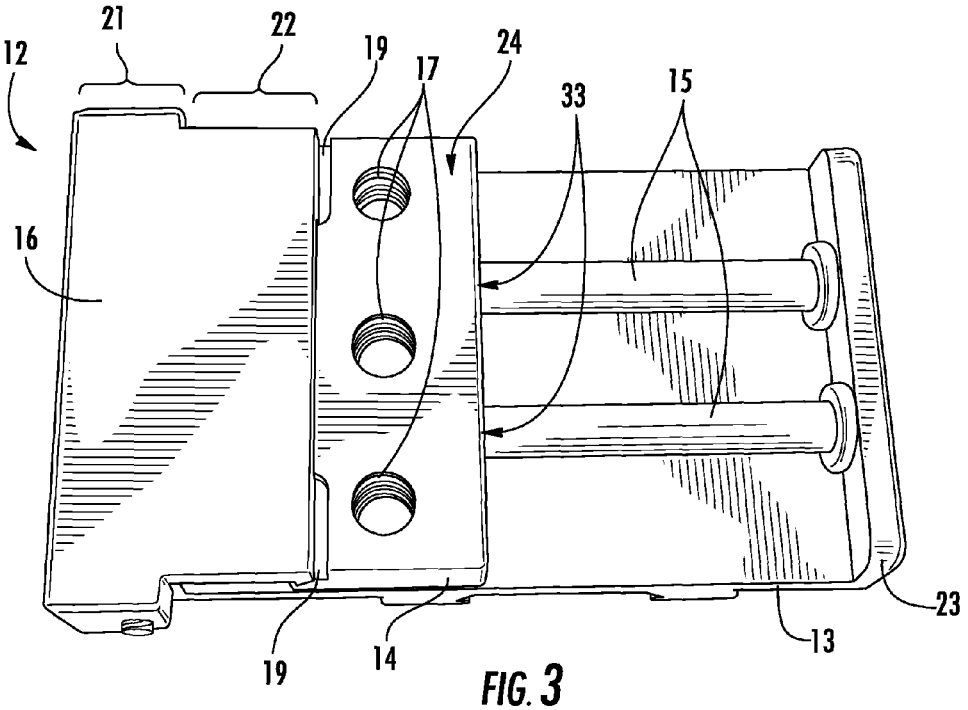
FIG. 3 is a top perspective view of the device shown in FIG. 1, with the sliding member in an engaged position.
Figure 4:
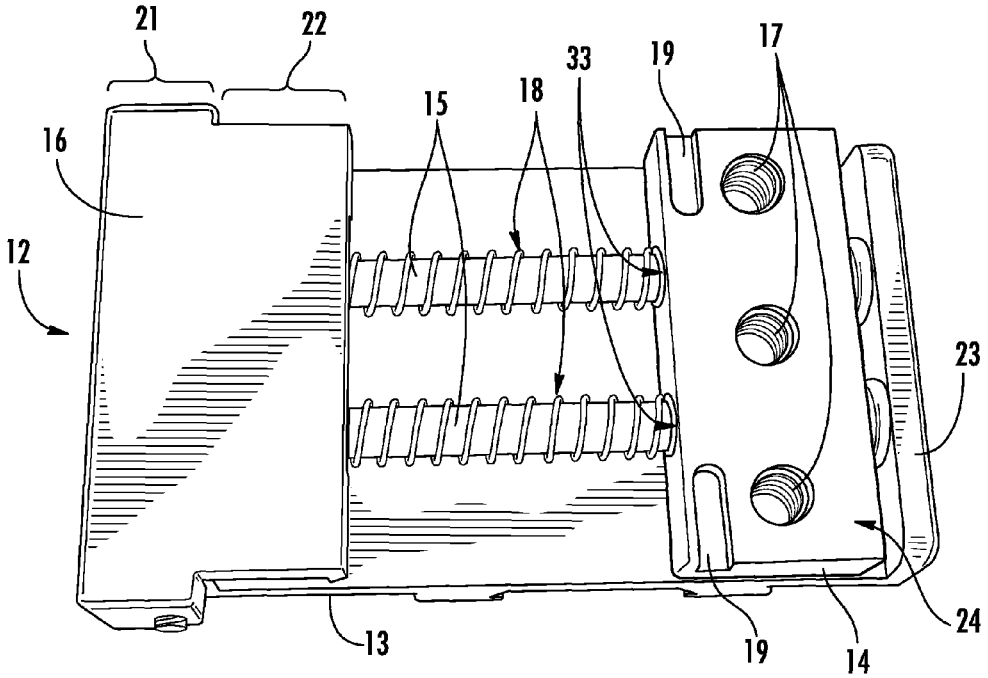
FIG. 4 is a top perspective view of the device shown in FIG. 1, with the sliding member in a disengaged position.
Figure 5:
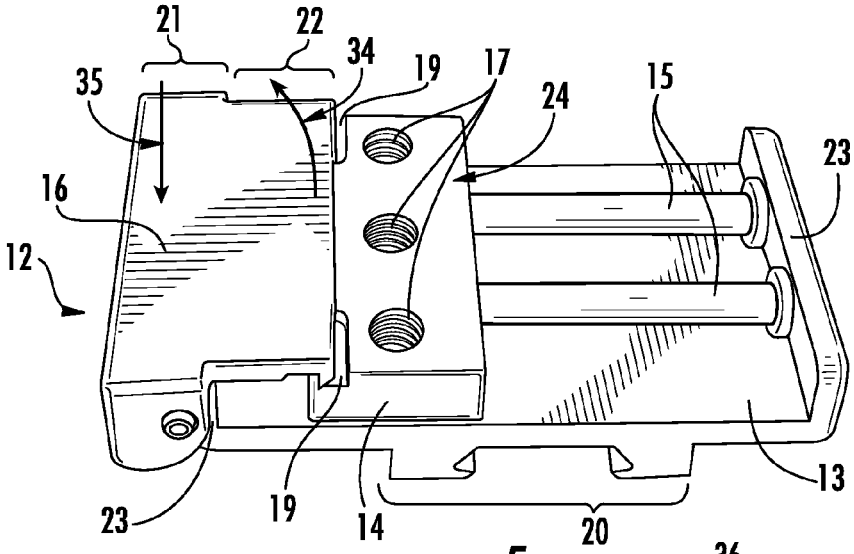
FIG. 5 is a top perspective view of the device shown in FIG. 1, illustrating a means for disengaging a locking means from the sliding member.
Figure 6:
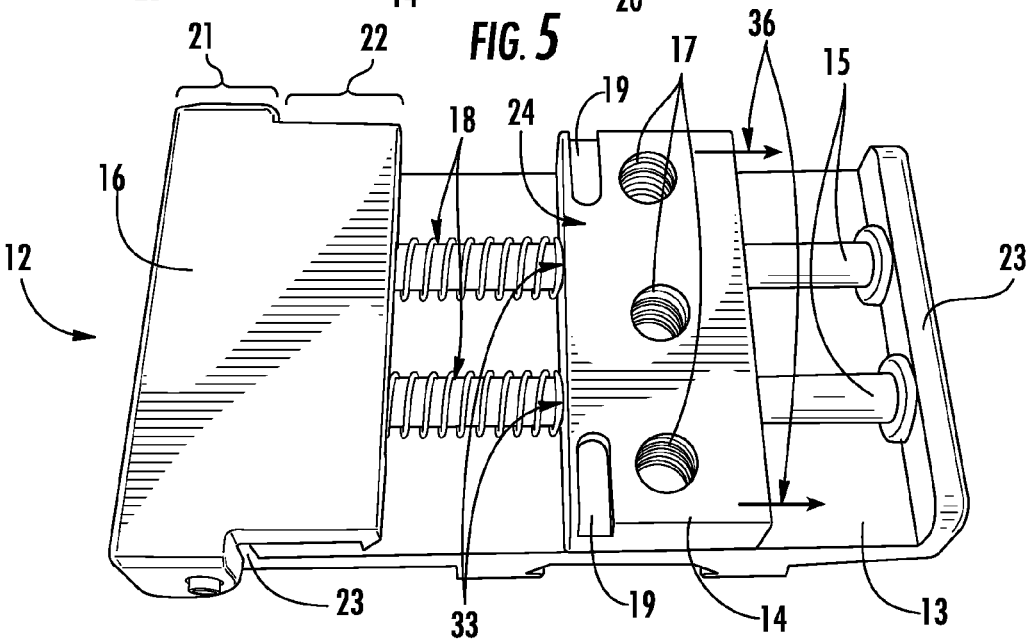
FIG. 6 is a top perspective view of the device shown in FIG. 1, illustrating a means for urging the sliding member across one or more guiding members towards the disengaged position.
Figure 7:
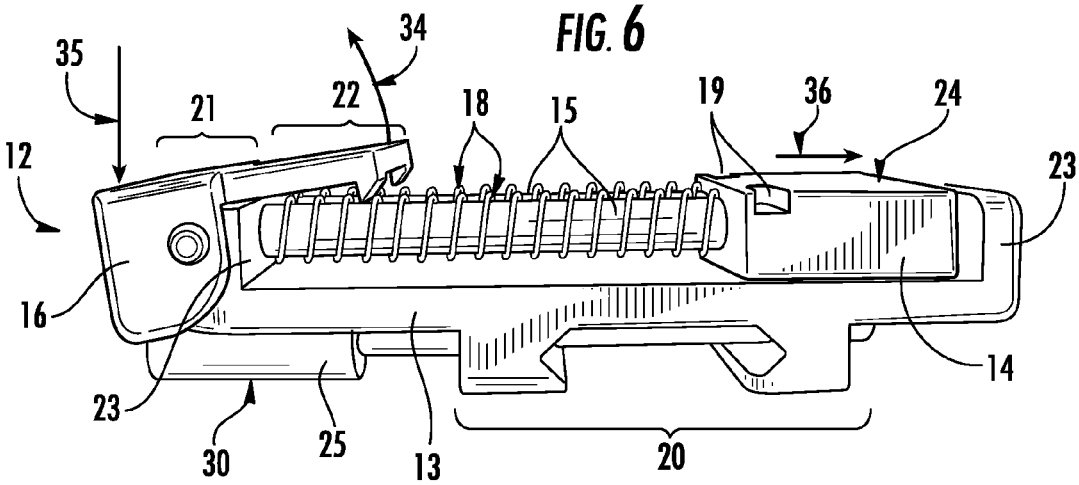
FIG. 7 is a side perspective view of the device shown in FIG. 1, illustrating a means for retaining the sliding member in the disengaged position.

The device 12 may further comprise a locking means 16 for selectively retaining or releasing the sliding member 14, thereby allowing the sliding member 14 to be reliably and selectively repositioned between an engaged position (as shown in FIG. 1) and a disengaged position (as shown in FIG. 2). In the depicted embodiment, the locking means 16 is arranged and configured to be selectively engaged with one or more grooves 19 formed on the upper surface 24 of the sliding member 14, thereby retaining the sliding member 14 in the engaged position (as illustrated in FIG. 1). Further, as shown in FIGS. 5-7, the locking means 16 may be arranged and configured so that a rear portion 21 of the locking means 16 may be depressed 35 to force the rear portion 21 of the locking means 16 to rotate downward 35 and to force a front portion 22 of the locking means 16 to rotate upward 34 in order to disengage the locking means 16 from the sliding member 14, thereby providing for the sliding member 14 to be moved to the disengaged position. See FIG. 7. Additionally, as in the depicted embodiment, a resilient member 18 may be provided and arranged to create a force 36 that, upon disengagement of the locking means 16 from the sliding member 14, urges the sliding member 14 across the guiding member 15 into the disengaged position. See FIGS. 6 and 7. It should be appreciated that the locking mechanism 16 may be accomplished by numerous means that selectively engage the sliding member 14 to retain the sliding member 14 in the engaged position and that selectively disengage from the sliding member 14 to release the sliding member 14 so that it may be repositioned in the disengaged position, all of which are considered to be within the spirit and scope of the present invention.

Figure 10:
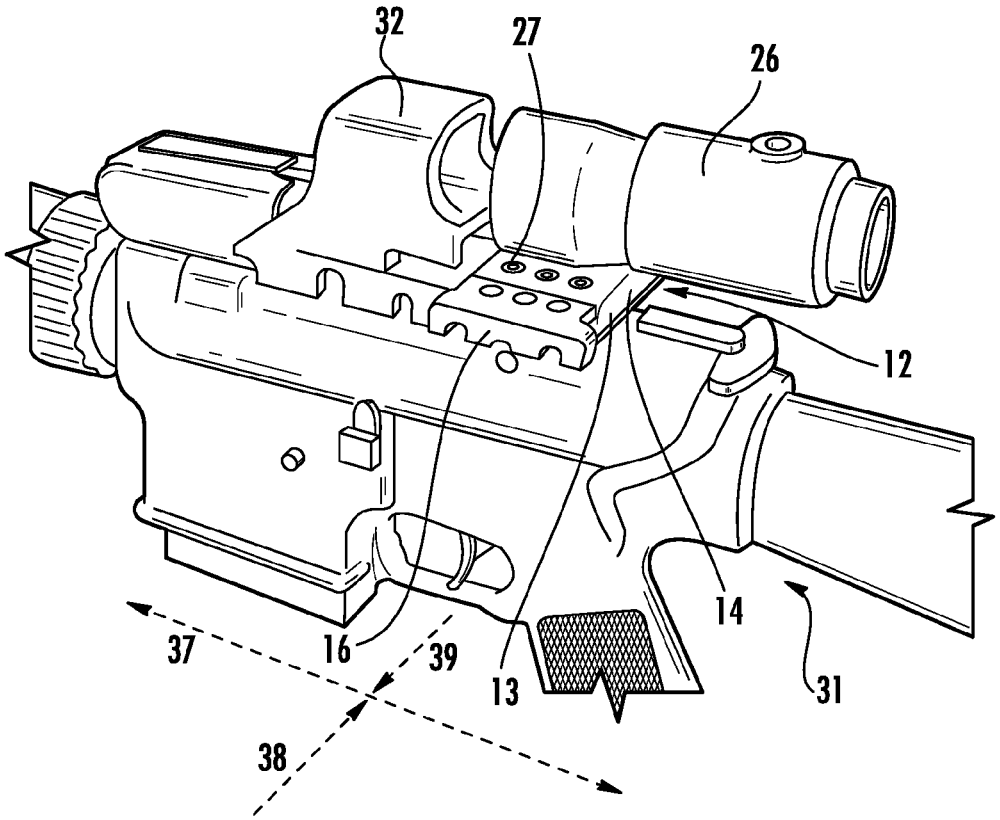
FIG. 10 is a side perspective view of the device shown in FIG. 1, illustrating the device installed onto a firearm, with the accessory in an operative position.
Figure 11:
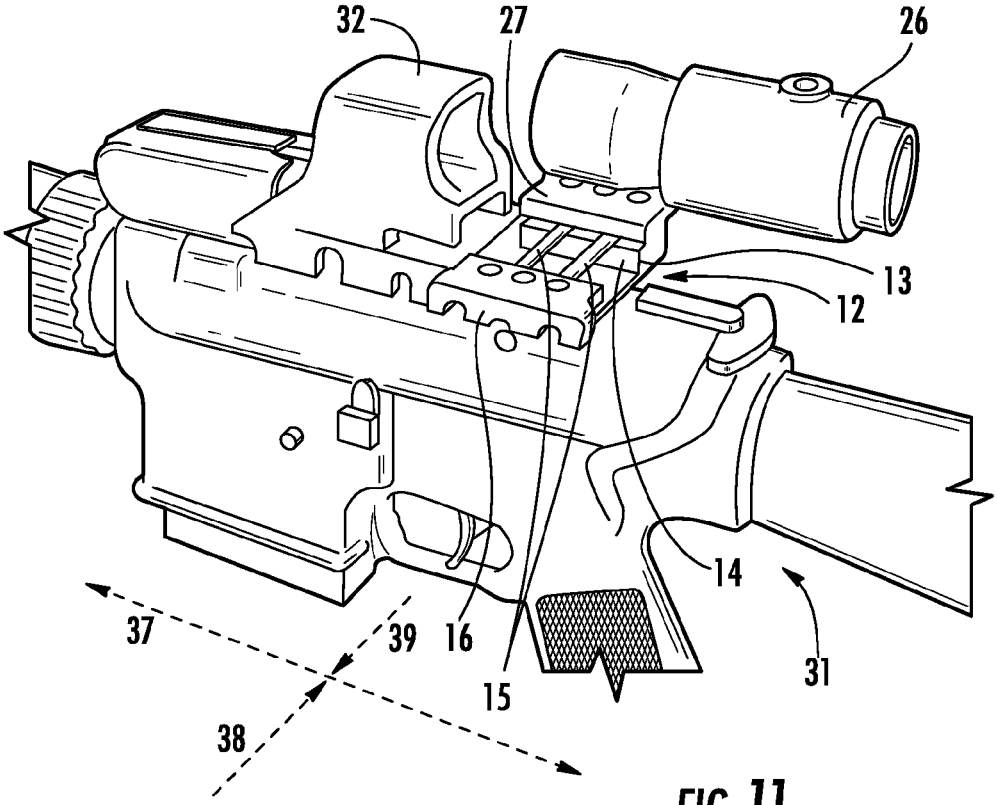
FIG. 11 is a side perspective view of the device shown in FIG. 1, illustrating the device installed onto a firearm, with the accessory in an inoperative position.

In operation, an accessory 26 is attached to the sliding mount adapter device 12 and the device 12 is installed onto a firearm 31. The guiding member 15 in combination with the base member 13 is configured in a manner that allows the accessory 26, which is attached to the sliding member 14, to slide back and forth across the guiding member 15 between an operative position (as shown in FIG. 10) and an inoperative position (as shown in FIG. 11). The locking means 16 is operable to retain the accessory 26 in the operative position when the accessory 26 is being used with the firearm 31. When the accessory 26 is not being used with the firearm 31, it may be repositioned to an inoperative position by simply depressing 35 the locking means 16 to disengage the locking means 16 from the sliding member 14. Upon disengaging the locking means 16 from the sliding member 14, the resilient member 18 operates to urge the sliding member 14 in a first direction 38 across the at least one guiding member 15 until the sliding member 14 is stopped in the inoperative position by, for example, engagement with an opposing end 23 of the base member 13. See FIGS. 5-7. As depicted in FIG. 7, the resilient member 18 yieldably opposes movement of the sliding member 14 in a second direction 39 opposite the first direction 38, thereby retaining the accessory 26 in the inoperative position. The user may move the accessory 26 back into the operative position by manually sliding the accessory 26 in the second direction 39 across the at least one guiding member 15 until the locking means 16 re-engages the sliding member 14. These steps may be repeated as needed by the user.

As illustrated in FIGS. 10 and 11, a holographic weapon sight 32 may be attached to the firearm 31 and positioned in an operative position for use with the firearm 31 as the primary optical sight 32 on the firearm 31. Additionally, a power multiplier accessory 26 may be installed onto the firearm 31 as a secondary optical sight 26 utilizing the sliding mount adapter device 12 of the present invention whereby the power multiplier 26 may be positioned in the operative position for engaging targets at medium to long range distances. See FIG. 10. The power multiplier 26 may be quickly repositioned into the inoperative position (as shown in FIG. 11) for engaging targets at close range distances, wherein simply using the holographic weapon sight is ideal. In another arrangement, both the primary 32 and the secondary 26 accessories and perhaps even additional accessories may all be mounted onto the firearm 31, each using the sliding mount adapter device 12 of the present invention.

Though the accompanying Figures illustrate the device 12 as being configured to laterally move an accessory 26 attached to a firearm 31 in linear directions 38 & 39 between the operative and inoperative positions (see FIGS. 10 and 11), the device 12 may also be configured to allow the sliding member 14 to slide in both lateral and vertical directions so that the accessory may be repositioned alongside barrel of the firearm 31 if so desired by the user. Furthermore, though the words first, engaged, and operative are used to describe positions of the device 12 or positions of parts of the device 12, and though at times a position may be described by more than one of these words, these words cannot be used interchangeably as these words each convey a different meaning. Likewise, second, disengaged, and inoperative cannot be used interchangeably as these words each convey a different meaning. When the mount adapter device 12 is installed onto a firearm 31, the operative position describes the position of an accessory 26 when the accessory 26 is being used in operation with the firearm 31. In most cases, an accessory 26 in the operative position will be located above the barrel of the firearm 31 substantially in alignment with the longitudinal axis 37 of the barrel of the firearm 31. In some situations, however, the position of the accessory 26 that is required to enable the user to use the accessory 26 with the firearm 31 may be at a different lateral and/or vertical position compared to the standard operative position located above the barrel of the firearm 31. For example, when a military user is wearing a chemical protective mask, it is virtually impossible for the user to use an accessory 26 in operation with a firearm 31 when the accessory is positioned slightly above the barrel of the firearm 31 due to the configuration of the mask. Thus, in such a situation, the operative position of an accessory 26 may be located at a position that is offset both laterally and vertically from the barrel of the firearm 31. Nevertheless, the operative position always describes a position in which the accessory 26 is disposed so that it may be used in operation with the firearm 31. On the other hand, the inoperative position describes the position of an accessory 26 when the accessory 26 is attached to the firearm 31 but is not being used in operation with the firearm 31. Next, whereas the first position describes a position of the sliding member 14 relative to the base member 13, the second position describes another position of the sliding member 14 relative to the base member 13 which is different from the first position. Finally, the engaged position describes the position of the sliding member 14 when it is being engaged and held in place by a locking means 16, compared to the disengaged position which describes a position of the sliding member 14 when it has been disengaged from the locking means 16 and moved to a position that is different from the engaged position.

Though the present invention is discussed herein particularly with its application to mount adapter devices for firearms, note that it is not intended to limit the spirit and scope of the present invention solely to use in conjunction with firearms. The present invention clearly has a wide range of application in circumstances wherein a device is intended to be attached to a support structure in a manner that allows the device to be slidably repositioned relative to the support structure. Many other uses of the present invention will become obvious to one skilled in the art upon acquiring a thorough understanding of the present invention. Furthermore, while the present invention has been illustrated by the description of one or more embodiments thereof, and while the embodiments have been described in considerable detail, the foregoing is considered as illustrative only of the principles of the invention and it is not intended to restrict or in any way limit the scope of the appended claims to such detail. Once given the above disclosures, many other features, modifications, and variations will become apparent to the skilled artisan in view of the teachings set forth herein. Such other features, modifications, and variations are, therefore, considered to be a part of this invention, the scope of which is to be determined by the following claims.

The invention claimed is:

1. A sliding mount adapter device for attaching an accessory to a support structure, comprising:

a base member including a lower portion configured to attach to said support structure;

at least one guiding member connected to said base member;

a sliding member being slidably engaged with the at least one guiding member, said sliding member including an upper portion configured to receive and retain said accessory, wherein said sliding member is configured to be moved between a first position relative to said base member and a second position relative to said base member by sliding across the at least one guiding member; and a resilient member configured and arranged for urging the sliding member to slide across the guiding member from said first position to said second position.

2. The sliding mount adapter device according to claim 1, wherein the at least one guiding member is a channel formed in said base member.

3. The sliding mount adapter device according to claim 2, wherein the sliding member includes rotating members, said rotating members being engaged with said guiding member channel for allowing said sliding member to slide across said channel formed in said base member.

4. The sliding mount adapter device according to claim 1, wherein the at least one guiding member is an elongated rod connected to said base member.

5. The sliding mount adapter device according to claim 1, wherein said lower portion of said base member is configured to attach to said support structure by attaching to a weapon accessory rail mounted on said firearm support structure.

6. The sliding mount adapter device according to claim 1, wherein said device further includes a locking means configured and arranged for selectively engaging or disengaging said sliding member.

7. The sliding mount adapter device according to claim 6, wherein said locking means selectively engages said sliding member for retaining said sliding member in a non-moving position, and wherein said locking means selectively disengages said sliding member for releasing said sliding member for sliding movement across the at least one guiding member.

8. The sliding mount adapter device according to claim 6, wherein said locking means selectively engages said sliding member in an engaged position, said engaged position including a selectively operable means to impede movement of said locking means thereby preventing disengagement of said locking means from said sliding member.

9. The mount adapter device of claim 6, wherein said resilient member is configured and arranged for urging the sliding member to slide across the guiding member from said first position to said second position upon selectively disengaging said locking means from said sliding member.

10. The mount adapter device of claim 1, wherein said resilient member is at least one coil spring.

11. The sliding mount adapter device according to claim 1, wherein the support structure is a firearm.

12. The sliding mount adapter device according to claim 1, wherein said base member includes upwardly extending end structures, and said at least one guiding member includes two terminal ends, and wherein said terminal ends of the at least one guiding member are affixed to said end structures of said base member.

13. The sliding mount adapter device according to claim 1, wherein said upper portion of the sliding member is configured to receive and retain a weapon accessory rail.

14. A sliding mount adapter device for attaching an accessory to a support structure, comprising:

a base member including a lower portion configured to attach to said support structure;

at least one guiding member connected to said base member, wherein said at least one guiding member defines an elongated rod connected to said base member; and a sliding member being slidably engaged with the at least one guiding member, said sliding member including an upper portion configured to receive and retain said accessory, wherein the sliding member includes at least one hole therethrough for slidably receiving the at least one guiding member which allows said sliding member to slide across the at least one guiding member, and wherein said sliding member is configured to be moved between a first position relative to said base member and a second position relative to said base member by being moved across the at least one guiding member.

15. The sliding mount adapter device according to claim 14, wherein the support structure is a firearm.

* * * * *